US008646714B2

(12) United States Patent
Chen

(10) Patent No.: US 8,646,714 B2
(45) Date of Patent: Feb. 11, 2014

(54) PAPER SHREDDER CUTTING BLADE SET

(75) Inventor: Wayne Chen, Shanghai (CN)

(73) Assignee: Aurora Office Equipment Co., Ltd, Shanghai (CN)

( * ) Notice: Subject to any disclaimer, the term of this patent is extended or adjusted under 35 U.S.C. 154(b) by 0 days.

(21) Appl. No.: 13/506,423

(22) Filed: Apr. 18, 2012

(65) Prior Publication Data

US 2013/0099041 A1 Apr. 25, 2013

(30) Foreign Application Priority Data

Oct. 25, 2011 (CN) ..... 2011 1 0327535

(51) Int. Cl.
*B02C 13/20* (2006.01)
*B02C 18/16* (2006.01)

(52) U.S. Cl.
USPC ..... 241/236; 29/428; 29/788; 29/796; 241/100; 241/295; 144/231; 144/232; 144/233

(58) Field of Classification Search
USPC ..... 29/428, 788, 796; 241/100, 236, 295; 144/231, 232, 233
See application file for complete search history.

(56) References Cited

U.S. PATENT DOCUMENTS

| | | | | |
|---|---|---|---|---|
| 6,981,667 | B2 * | 1/2006 | Hunag | 241/295 |
| 6,983,903 | B2 * | 1/2006 | Chang | 241/236 |
| 7,637,448 | B2 * | 12/2009 | Hartnett et al. | 241/236 |
| 2004/0040348 | A1 * | 3/2004 | Ling | 70/52 |
| 2007/0125895 | A1 * | 6/2007 | Chen | 241/236 |
| 2009/0256020 | A1 * | 10/2009 | Sued et al. | 241/297 |
| 2010/0294870 | A1 * | 11/2010 | Wang | 241/291 |

* cited by examiner

*Primary Examiner* — Shelley Self
*Assistant Examiner* — Onekki Jolly
(74) *Attorney, Agent, or Firm* — WHGC, P.L.C.; John F. O'Rourke

(57) ABSTRACT

A blade set for paper shredders is disclosed. In one embodiment, a notched blade having at least two notches in proximity to a central hole is brought into contact with a mating blade also having a central hole. Force is applied to the mating blade in such a fashion as to displace some of the body of the mating blade into the notches. This acts to substantially secure the blades together. In another embodiment, the notches are disposed on the edge of the blade and through the periphery. In yet another embodiment, one blade can have holes and not notches.

1 Claim, 5 Drawing Sheets

PAPER SHREDDER CUTTING BLADE SET

FIELD OF THE INVENTION

The present invention relates to shredder blades. More particularly to a blade set comprised of two blades.

BACKGROUND OF THE INVENTION

Paper shredding machines perform a valuable function in destroying documents that otherwise might be misused. Even though there are many varieties and special functions of these machines, they typically all rely upon cutting blades to shred the documents.

The cutting blades must be sturdy enough to withstand the rigor of shredding a great deal of paper. Also, the blades must be economical to produce and easy to incorporate into the paper shredders to enable a low cost of manufacturing.

In many shredders, the assembled cutter structure can be a combination of single blades and blade sets where the blade sets are made of usually two blades affixed together. This arrangement has proven quite successful and efficient in the shredder industry.

There are a number of ways to affix two blades together to arrive at a blade set. These processes could include forms of welding that permanently affix the blades together, or mechanical attachments between the blades where the blades could be remove from one another rather easily.

It is desirable to have the blades more permanently affixed, but processes like welding can be costly and time consuming. What is needed is a way to affix two blades together in a relatively permanent fashion that is less costly and less time consuming than current methods.

SUMMARY OF THE INVENTION

In one embodiment, the novel blade set uses a stamping process to secure two blades together by forcing material from a mating blade into two notches on a notched blade.

In another embodiment the notches are in the general vicinity of a center hole of the notched blade.

In another embodiment the notches can be in the general vicinity of the periphery of the notched blade.

In yet another embodiment, there is a hole through the body of one blade.

In yet another embodiment, the blades can be secured together by a combination of notches and holes.

BRIEF DESCRIPTION OF THE DRAWINGS

The invention is generally shown by way of reference to the accompanying drawings in which.

DETAILED DESCRIPTION OF THE INVENTION

Figure 1:
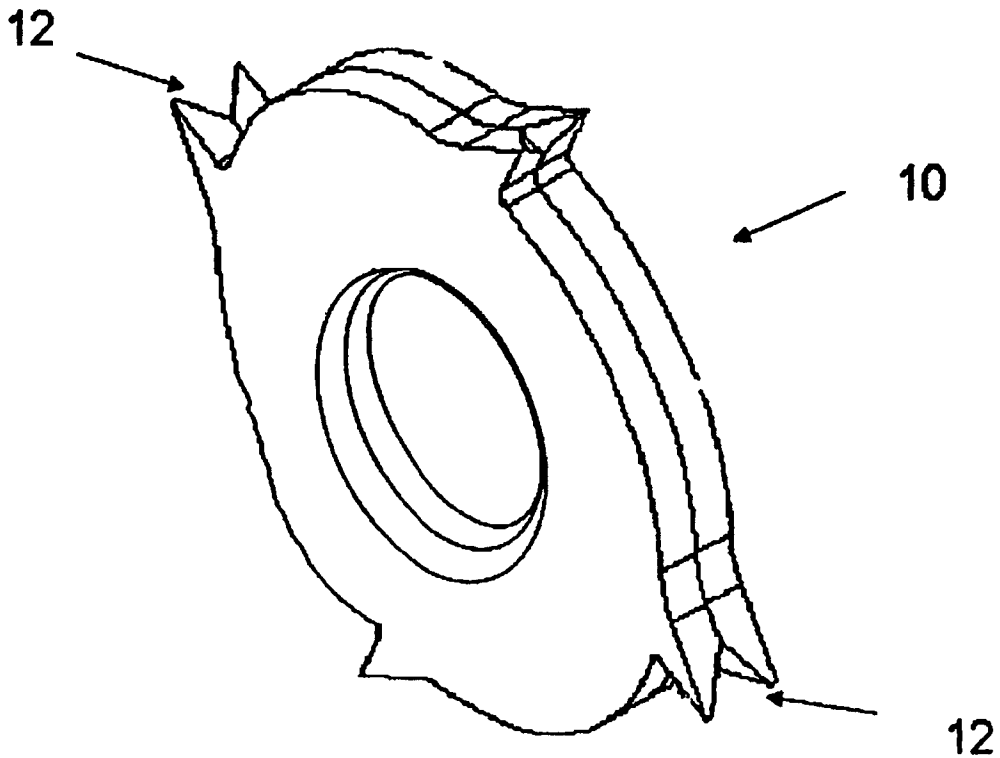
FIG. 1 is a perspective view of a prior art blade set.

FIG. 1 is an example of two blades joined together to form a blade set (10) with a V shaped blade (12) as might be found in the prior art. The blades are could be joined by welding or other such methods. Each blade also has a hole to retain an arbor. In the figure, the holes are generally in alignment.

Figure 2:
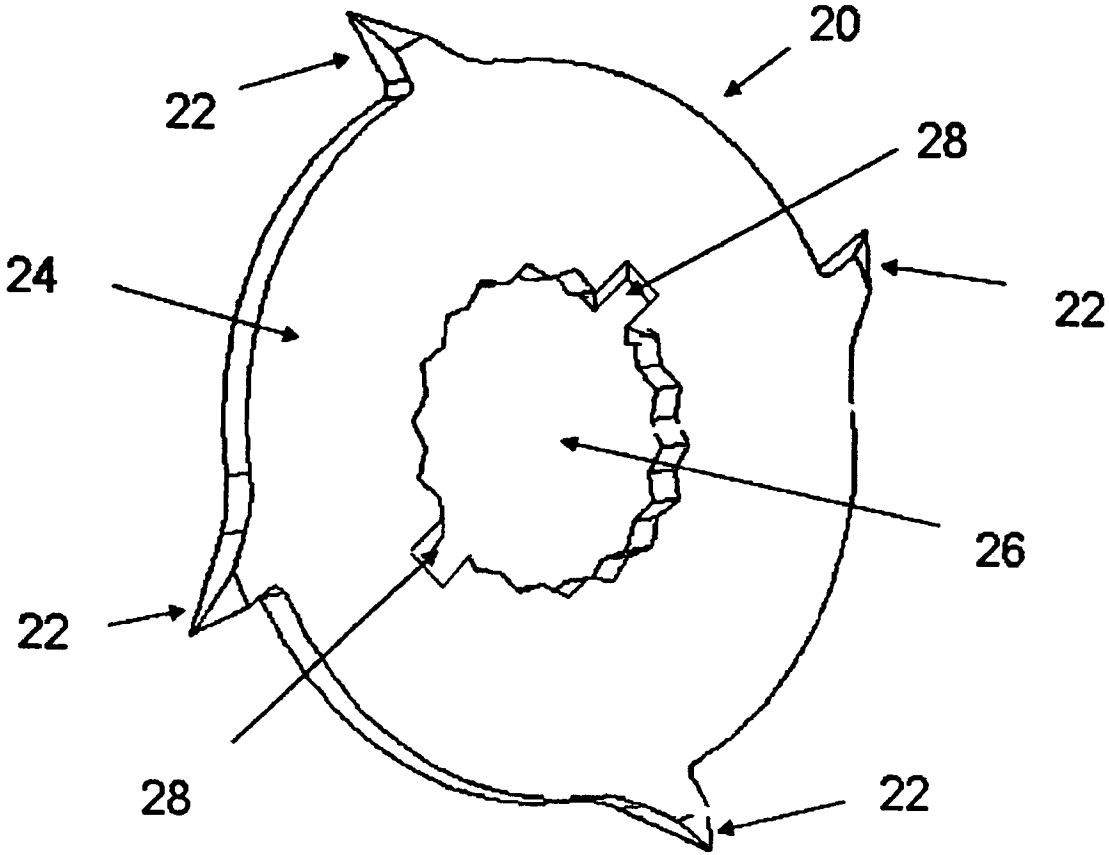
FIG. 2 is a perspective view of a blade with notches.
Figure 3:
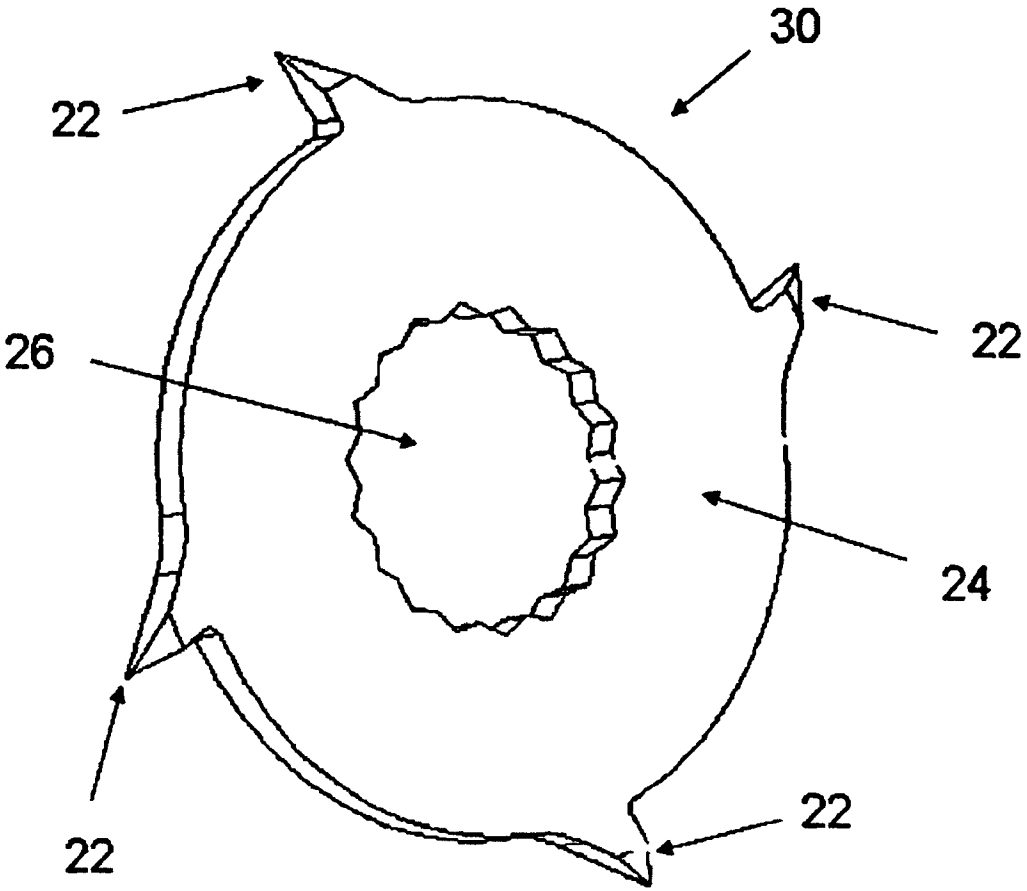
FIG. 3 is a perspective view of a blade without notches.

In an embodiment of the invention, a blade set is formed from two blades—a notched blade and a mating blade—combined together. FIG. 2 is an example of the notched blade (20). FIG. 3 is an example of the mating blade (30). FIG. 2 and FIG. 3 identify four knife edges (22) as one embodiment of the invention. However, the invention encompasses two or more knife edges on each blade.

Each blade is approximately disc shaped, but the shape can vary as long as the shape is functional within a paper shredder. Each blade has a body (24) and an opening or hole (26) in approximately the center of the body to accommodate a cutting arbor.

Turning to FIG. 2, the notched blade has a notch cut (28) in the body of the blade extending from a point in the body of the blade to the center hole (26). In the embodiment being addressed there are two notches (28) and the notches are on opposing sides of the center hole (26). In other embodiments there can be more than two notches with a variety of locations around the center hole.

Addressing FIG. 3, the mating blade does not have a notch cut.

Figure 4:
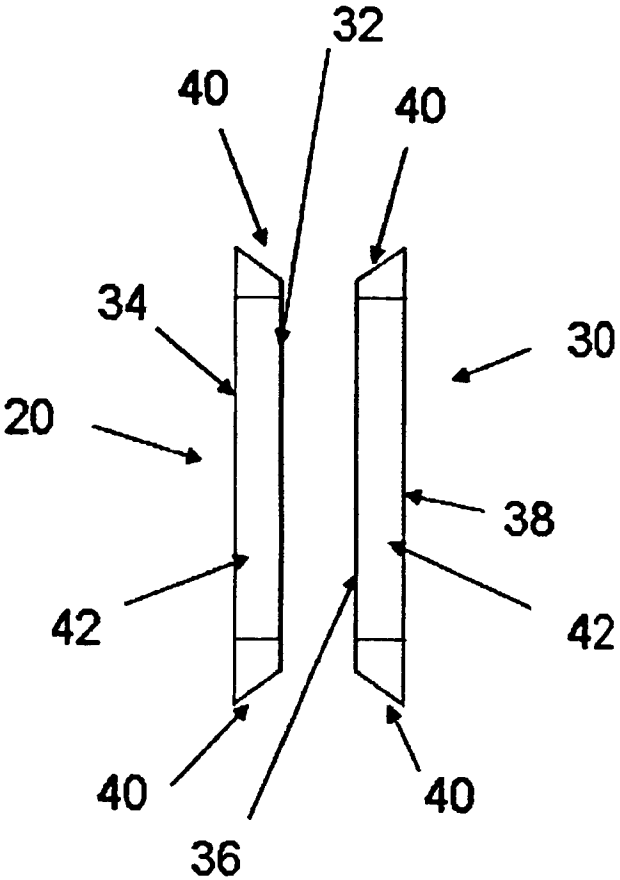
FIG. 4 is a side view highlighting the substantially flat sides of the blades.

FIG. 4 shows opposing substantially flat surfaces for each blade and an outer periphery. The notched blade (20) has a first substantially flat surface (32) and a second substantially flat surface (34). The mating blade (30) also has a first substantially flat surface (36) and a second substantially flat surface (38). Each blade has at least two slanted knife edges (40) on the outer periphery (42) of the body of the blade and the knife edges are disposed generally opposite one another on the periphery. In other embodiments, the knife blades could take shapes other than being slanted and more than two blade knives could be used.

Figure 5:
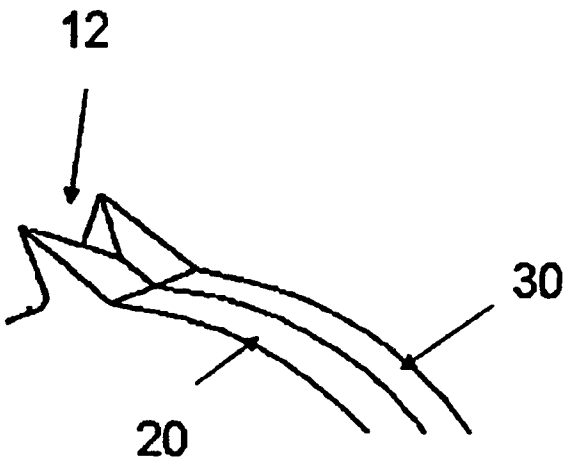
FIG. 5 is a perspective view of a blade set having a V shaped blade formed from two blades.

In FIG. 5, the notched blade (20) and the mating blade (30) are in contact in such a way as to result in a V shaped blade (12).

Figure 6:
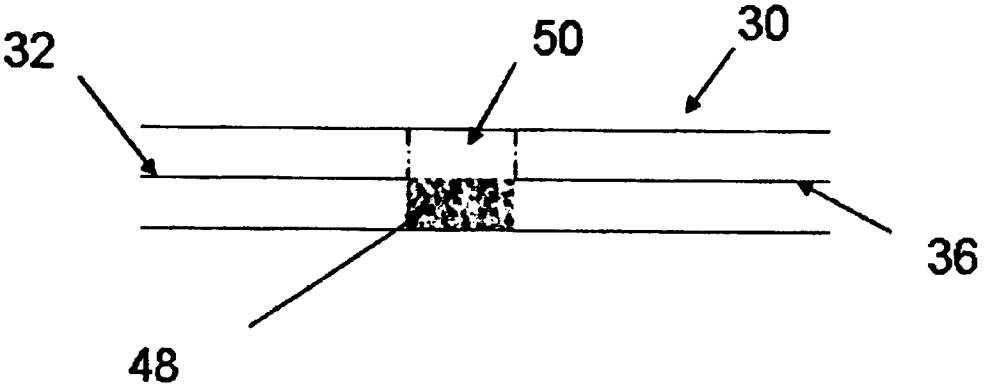
FIG. 6 is a cutaway side view of the notched blade in contact with the mating blade.

FIG. 6 identifies the notch blade (20) in proximity with the mating blade (3) with the first substantially flat surfaces of each blade in contact. The notch (48) is shown as is the area in the mating blade (50) that is over the notch.

Figure 7:
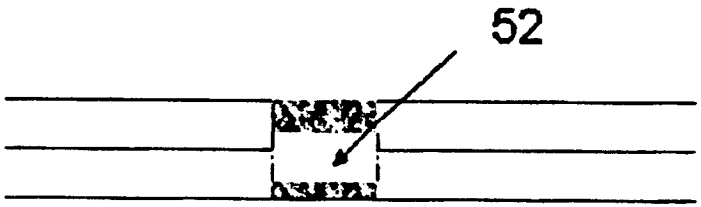
FIG. 7 is a cutaway side view of the notched blade in contact with the mating blade with material from the mating blade being disposed with in the notch.

Addressing FIG. 7, in the current embodiment, force is applied to the area of the mating blade (50) over the notch such that material (52) is displaced into some portion of the notch (48) of FIG. 6. The displaced material (52) is still connected to some degree with the mating blade (30). The material (52) within the notch (48) secures the notch blade (20) to the mating blade (3) and the result is the blade set.

The material in the notch (52) can be described as a press or friction fit such that the notch blade (20) and mating blade (30) are held together. The tightness can be regulated as desired in a particular application. Thermal expansion or contraction can also be employed in other embodiments to vary the allowance.

In another embodiment, the notch could be formed by removing material from the body of the notched blade to the periphery. Forcing the material from the mating blade into the notch would proceed in generally the same fashion as identified above.

In another embodiment, holes could be formed through the opposing sides of one blade instead of using notches. Again, the material from the mating blade could be forced into the hole in generally the same fashion as identified above.

In yet another embodiment, combinations of holes and/or notches could be used to join the blades into a blade set.

While embodiments have been described in detail, it should be appreciated that various modifications and/or variations may be made without departing from the scope or spirit of the invention. In this regard it is important to note that practicing the invention is not limited to the applications described herein above. Many other applications and/or alterations may be utilized provided that such other applications and/or alterations do not depart from the intended purpose of the invention. Also, features illustrated or described as part of one embodiment may be used in another embodiment to provide yet another embodiment such that the features are not limited to the embodiments described herein above. Thus, it is intended that the invention cover all such embodiments and variations. Nothing in this disclosure is intended to limit the scope of the invention in any way.

What is claimed is:

1. A method of manufacturing a paper shredder blade set using a notched blade having a substantially round and generally flat shaped body, a first and second opposing substantially flat sides, a center hole adapted to receive a cutting arbor, at least two knife edges disposed on a periphery of the body, and at least two notches with each notch extending from a point in the body through the periphery and through the substantially flat sides, and a mating blade having a substantially round and generally flat shaped body, a first and second opposing substantially flat sides, a center hole adapted to receive a cutting arbor, and at least two knife edges disposed on a periphery of the body; comprising the steps of:

placing the first substantially flat side of the notched blade in contact with the first substantially flat side of the mating blade such that each of the knife edges on the notched blade substantially align with a corresponding knife edge on the mating blade;

aligning the knife edges on the notched blade and the mating blade forming a blade set with a V shaped blade; and applying force to the second side of the mating blade in a location generally opposite the notch in the notched blade such that an amount of the material from the body of the mating blade is disposed within the notch of the notched blade such that a portion of the material in the notch remains forcibly attached to the mating blade and the notched blade and the mating blade are substantially secured to one another.

* * * * *